US008049619B2

(12) United States Patent
Armstrong et al.

(10) Patent No.: US 8,049,619 B2
(45) **Date of Patent: *Nov. 1, 2011**

(54) MONITORING SYSTEM AND DEVICE

(75) Inventors: Gary Armstrong, Coal Creek (CA); Craig Demmings, Minto (CA); Wayne Wainwright, Chipman (CA); George Watson, Agincourt (CA); Leo Chalan, Willowdale (CA); Dan Small, Dirtmouth (CA)

(73) Assignee: Armstrong's Communication Ltd., New Brunswick (CA)

( * ) Notice: Subject to any disclaimer, the term of this patent is extended or adjusted under 35 U.S.C. 154(b) by 147 days.

This patent is subject to a terminal disclaimer.

(21) Appl. No.: 12/554,728

(22) Filed: Sep. 4, 2009

(65) Prior Publication Data

US 2010/0066536 A1 Mar. 18, 2010

Related U.S. Application Data

(63) Continuation-in-part of application No. 11/586,681, filed on Oct. 26, 2006, now Pat. No. 7,586,409.

(51) Int. Cl.
*G08B 13/08* (2006.01)

(52) U.S. Cl. ..... 340/545.6

(58) Field of Classification Search ..... 340/545.6, 340/539.22, 426.19, 539.13, 988, 825.49, 340/825.36, 505

See application file for complete search history.

(56) References Cited

U.S. PATENT DOCUMENTS

| | | | | |
|---|---|---|---|---|
| 5,917,411 | A * | 6/1999 | Baggarly | 340/569 |
| 7,218,215 | B2 * | 5/2007 | Salisbury et al. | 340/505 |
| 7,265,668 | B1 * | 9/2007 | Brosius | 340/539.22 |
| 2004/0196182 | A1 * | 10/2004 | Unnold | 342/357.07 |
| 2006/0164239 | A1 * | 7/2006 | Loda | 340/539.22 |

* cited by examiner

*Primary Examiner* — Phung Nguyen

(74) *Attorney, Agent, or Firm* — Eugene F. Derenyi; Fogler, Rubinoff LLP

(57) ABSTRACT

A monitoring system, for monitoring an object, which includes a microprocessor comprising a memory to store data, and a control program executed by said microprocessor, said microprocessor having a stand-by mode and an active mode, a communications means connected to said microprocessor for transmitting data from said microprocessor to a monitoring station, a zone monitoring device on the object connected to said microprocessor in a loop with said microprocessor in said stand-by mode, a power source for supplying power to said microprocessor, communications means and zone monitoring device, wherein upon said microprocessor receiving an input signal from said zone monitoring device, said control program directs said microprocessor to switch to active mode, generate and store in said memory an alarm message corresponding to said input signal from said zone monitoring device, activate said communications means, and transmit said alarm message to a monitoring station.

20 Claims, 11 Drawing Sheets

MONITORING SYSTEM AND DEVICE

CROSS-REFERENCE TO RELATED APPLICATIONS

This application is a continuation-in-part of U.S. patent application Ser. No. 11/586,681, which claims benefit of PCT Patent Application No. PCT/CA2005/000629, filed Apr. 26, 2005, which further claims benefit of U.S. Provisional Patent Application No. 60/564,941, filed Apr. 26, 2004; the contents of each incorporated herein by reference in their entirety.

FIELD OF THE INVENTION

This invention relates to monitoring systems and in particular, monitoring systems with sensors.

BACKGROUND OF THE INVENTION

In conventional postal and courier drop off boxes, there is no way to determine whether there are articles in the box without someone physically checking the contents of each box. This results in many unnecessary pick-up stops by postal and courier workers at empty boxes.

Conventional postal and courier drop off boxes are also susceptible to tampering, vandalism and theft, which is usually only discovered by postal or courier workers at the next scheduled pick-up.

In addition, in today's age of terrorism, packages containing explosives, chemical or biological threats can be left in drop off boxes and remain undetected thus posing a threat to persons using the box or situated near it.

Prior art drop off boxes have been proposed which include some security features. One such drop off box is disclosed in PCT publication WO 00/76378 entitled Network Connected Delivery Box Using Access Codes and Method for Providing Same, published on Dec. 21, 2000 and naming Holtkamp et al as inventors. The Holtkamp application discloses a delivery box which includes a communications unit linking the box with a central computer at a delivery box company. The box is equipped with sensors for detecting when items are placed in the box and for monitoring the ambient temperature in the box.

Item placement and ambient temperature data from the sensors is transmitted by the communications unit via a portal interface with a cellular or satellite communications link to the central computer. The box can be integrated through the portal interface with a delivery company's GPS tracking system.

PCT publication WO 97/43935 entitled A Mail Box, published on Nov. 27, 1997 and naming Lateo as inventor discloses a mail box which includes a microprocessor controlled locking system which can be activated in the event of an attempted forced entry into the mail box. A sensor detects the deposit of articles into the box. The box is linked to a monitoring centre by a communications link.

None of the prior art boxes discussed above include sensors for detecting the deposit of hazardous materials in the box. Furthermore, where the security and communication systems in the prior art boxes are battery powered, no power saving functionality is taught.

Thus there is a need for a monitoring system having a low-power stand-by mode which permits the monitoring system to be operational over extended periods of time.

SUMMARY OF THE INVENTION

The above-mentioned need is met by the invention by providing in one embodiment a monitoring system, for monitoring an object, which includes a microprocessor comprising a memory to store data, and a control program executed by said microprocessor, said microprocessor having a stand-by mode and an active mode, a communications means connected to said microprocessor for transmitting data from said microprocessor to a monitoring station, a zone monitoring device on the object connected to said microprocessor in a loop with said microprocessor in said stand-by mode, a power source for supplying power to said microprocessor, communications means and zone monitoring device, wherein upon said microprocessor receiving an input signal from said zone monitoring device, said control program directs said microprocessor to switch to active mode, generate and store in said memory an alarm message corresponding to said input signal from said zone monitoring device, activate said communications means, and transmit said alarm message to a monitoring station.

In another embodiment, this invention provides a device which includes a microprocessor comprising a memory to store data, and a control program executed by said microprocessor, said microprocessor having a stand-by mode and an active mode, a communications means connected to said microprocessor for transmitting data from said microprocessor to a monitoring station, a power source for supplying power to said microprocessor and communications means, wherein upon said microprocessor receiving an input signal, said control program directs said microprocessor to switch to active mode, generate and store in said memory an alarm message corresponding to said input signal, activate said communications means, and transmit said alarm message to a monitoring station. The device may or may not include a zone monitoring device in communication with said microprocessor in a loop with said microprocessor in stand-by mode.

DESCRIPTION OF THE DRAWINGS

The invention is described below in greater detail with reference to the accompanying drawings, which illustrate preferred embodiments of the invention and wherein.

DETAILED DESCRIPTION OF THE PREFERRED EMBODIMENTS

Figure 1:
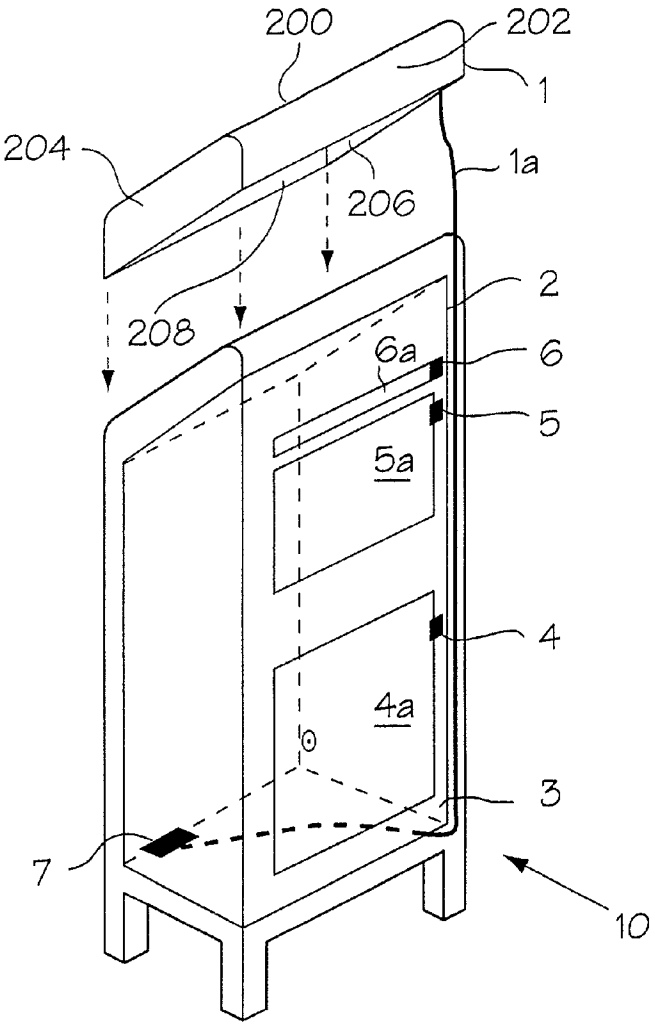
FIG. 1 is a perspective view of a postal box retrofitted with a monitoring system according to the invention.

Referring to FIG. 1, a conventional postal box of the type commonly used by Canada Post indicated generally at 10 is shown retrofitted with a monitoring system according to the invention. The box 10 includes a monitoring unit 1 which is housed in a cap which can be fitted to the top of the postal box 10 to retrofit it. The hollow cap 1 includes a top 200 and sides 202, 204, 206 and 208. The unit 1 is connected to surface mounted magnetic contacts 4, 5, 6 on doors 4*a*, 5*a* and 6*a* respectively of the box 10 via wire 1*a*. Contacts 4, 5, 6 correspond to zones 1, 2, 3 of the monitoring system. Wiring is used to connect the unit 1 to the contacts 4, 5 and 6 via a surface mounted contact 3, model GRI29AWH.

A hollow tube 2 houses the wiring 1*a* to keep it from interfering with the operation of the box 10. The unit 1 is also connected by wire to a smoke detector 7, model DSCMN-140 C. The smoke detector 7 corresponds to zone 4 of the monitoring system.

Other contacts or sensors can be incorporated in the monitoring system depending upon operational requirements. For example, sniffer sensors for detecting bombs and biological agents placed inside the postal box 10 by terrorists can be used. Temperature sensors can also be used to monitor temperature within and without the postal box. A GPS system can also be incorporated into the system for tracking the position of the postal box should it be removed from its location by vandals or thieves. A potentiometer or mercury switch can also be used inside the postal box 10 and connected to the monitoring unit 1 to monitor whether the postal box 10 has been tipped or moved. All such sensors are connected to the monitoring unit 1 in a similar fashion to the magnetic contacts 4, 5, 6 or the smoke detector 7 as described above.

Figure 2:
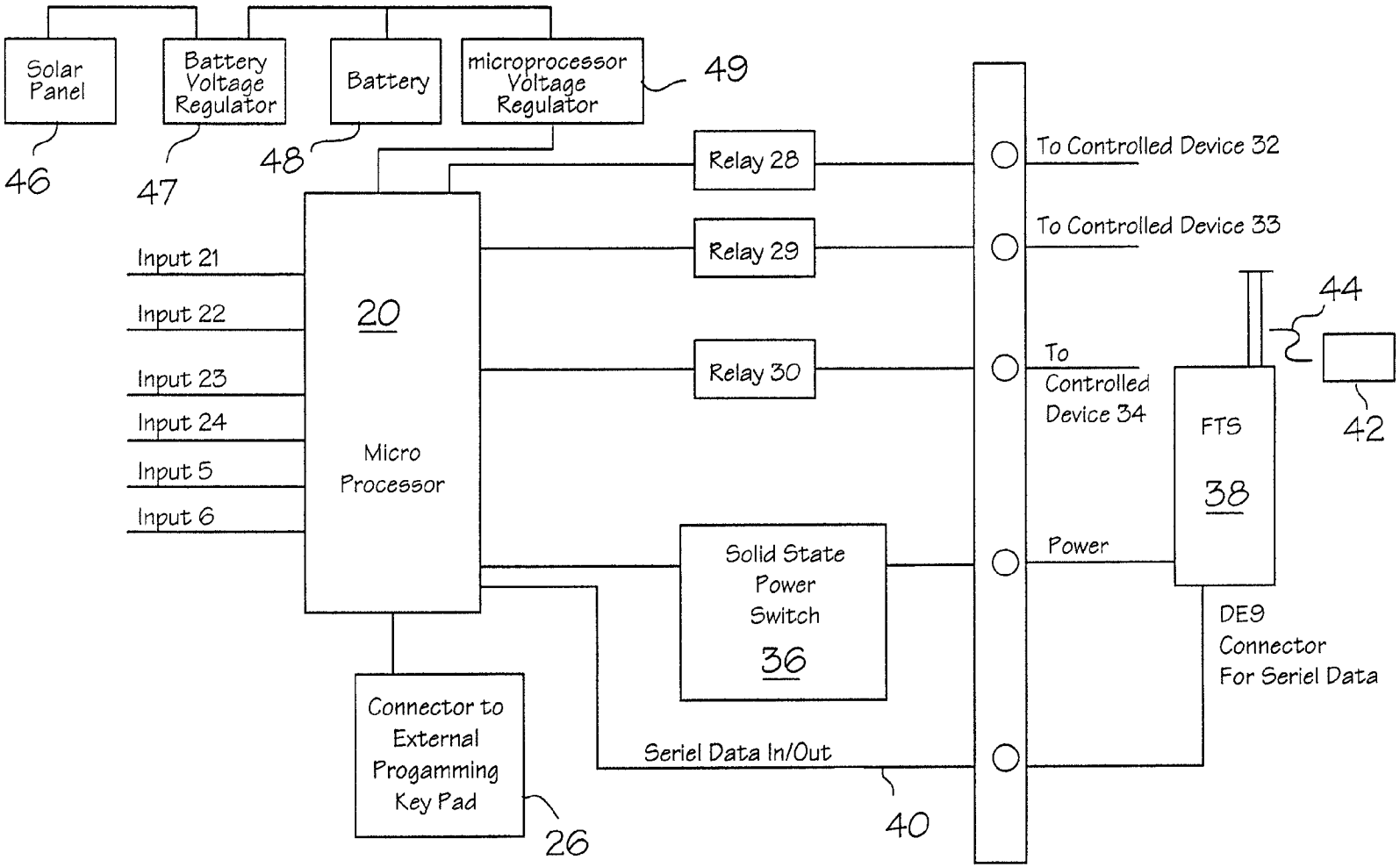
FIG. 2 is a block diagram of a low power controller according to the invention.

FIG. 2 is a block diagram of a monitoring system according to the invention. The system is controlled by a microprocessor 20 integrated with a smart circuitry board low power controller (discussed in more detail below) which forms part of the monitoring unit 1. Inputs 21 to 24 are connected to the microprocessor 20 and are the inputs from the magnetic contacts 4, 5, 6 and detector 7, respectively. The microprocessor 20 is also connected to a connector 26 which can be used to connect an external programming key pad (not shown) to the microprocessor 20.

Microprocessor 20 is connected to three relays, 28, 29 and 30 which in turn are connected to controlled devices 32, 33 and 34. The controlled devices 32 to 34 can be motor driven locks, for example, which can be activated to lock the doors of the postal box 10 in the event of a hazardous package being detected in the postal box 10.

The microprocessor 20 is also connected to a solid state power switch 36 which in turn is connected to a Fast Track System ("FTS) radio 38 manufactured by Numerex Corp. of Atlanta, Ga., U.S.A. (other suitable wireless communications devices can also be used). A serial data in/out connection 40 connects the microprocessor 20 to the FTS radio 38. The FTS radio 38 communicates to a central monitoring station 42 via cellular network 44.

A solar panel 46 is connected to a battery voltage regulator 47 which in turn is connected to a rechargeable battery 48 and a microprocessor voltage regulator 49 and then to the microprocessor 20 to provide power to the monitoring system. The solar panel 46 charges the battery 48. The regulator 47 down regulates the voltage from the solar panel 46 to 12V and the regulator 49 in turn down regulates the voltage to 3.3V, the operating voltage of the microprocessor 20.

Low Power Controller

Figure 3:
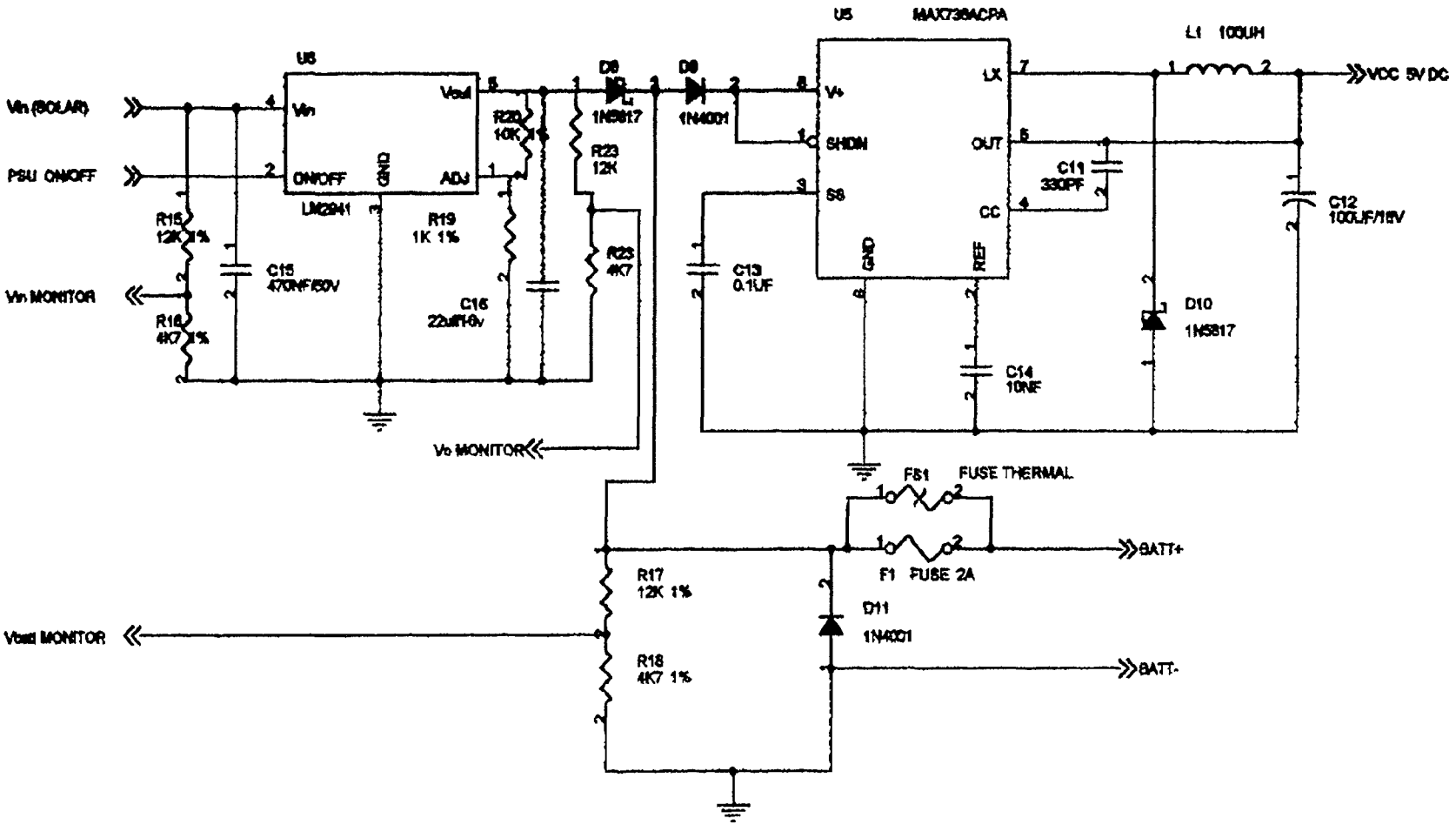
FIG. 3 is a schematic block diagram of a power supply for a low power controller according to the invention.
Figure 4:
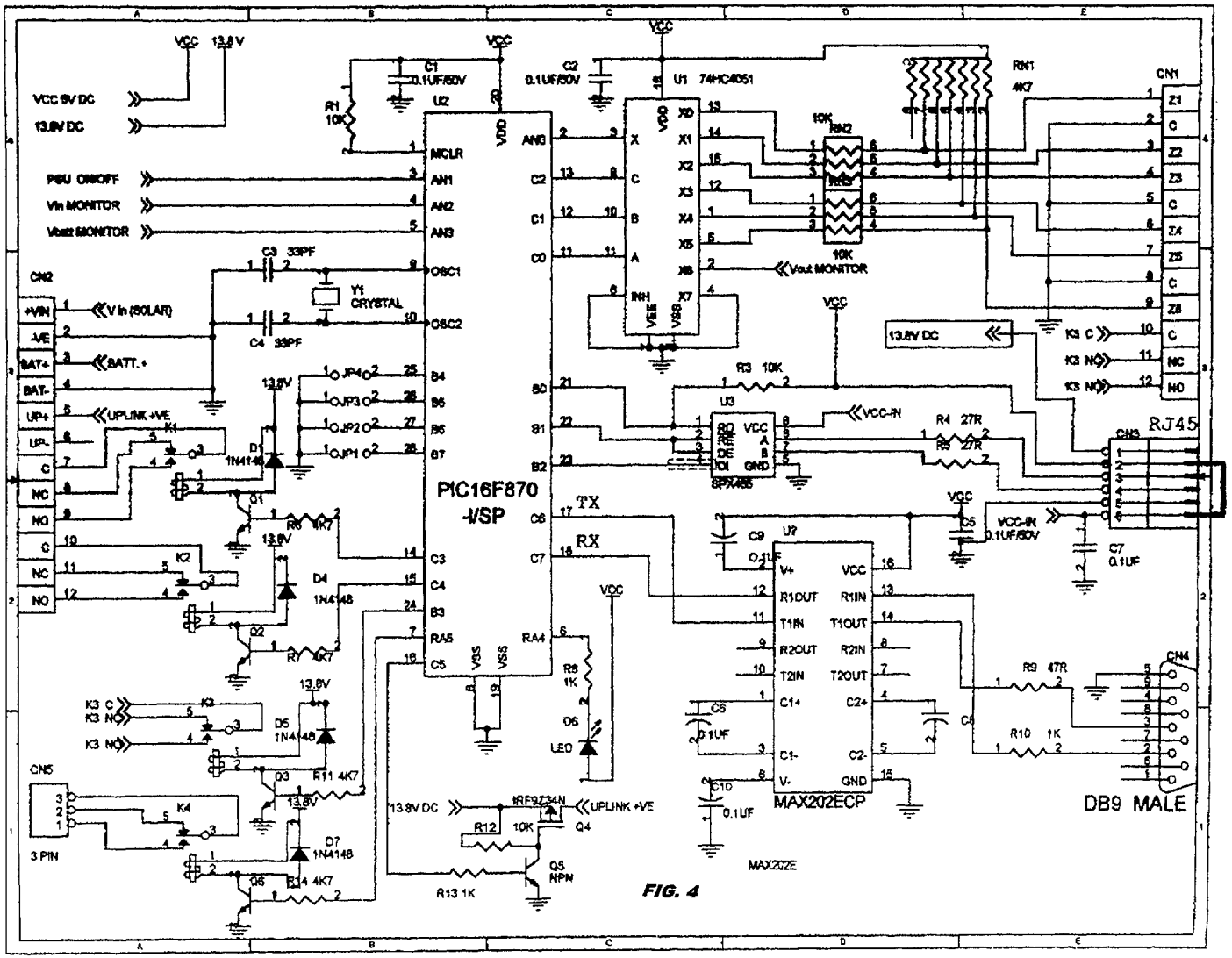
FIG. 4 is a schematic/block diagram of a low power controller according to the invention.
Figure 5:
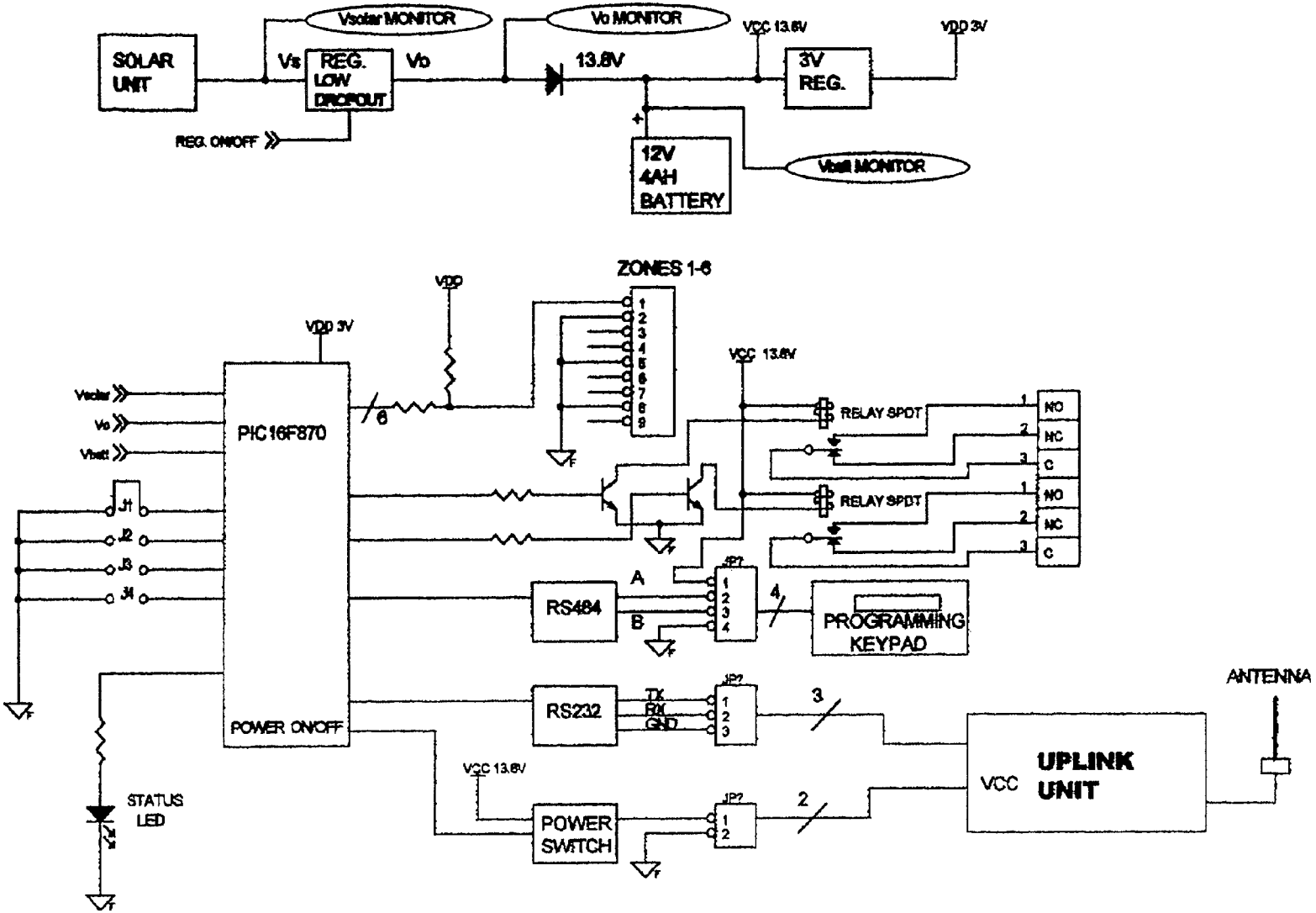
FIG. 5 is a schematic/block diagram of a low power controller according to the invention.

Referring to FIGS. 3, 4, and 5, the low power controller of the invention includes a circuit board with a PIC 16F870-I/SP ("PIC") microprocessor for controlling the operation of the monitoring system of the invention. The PIC microprocessor is designed to operate in a stand-by low power (sleep) mode and in a full power an active mode. The PIC processor controls the operation of the controller using a control program comprised of code programmed in C++.

The PIC microprocessor is connected to a 74HC4051 multiplexer. The multiplexer is connected to an RN2 resistor network. The RN2 resistor network is connected to a terminal strip connector CN1 with input screws Z1 to Z6 and common screws C.

The PIC microprocessor is also connected to an SPX 485 driver which in turn is connected to an RJ45 jack which can be used to connect the controller to a hand-held key pad.

The PIC microprocessor is also connected to a MAX202ECP 9 ("MAX") RS-232 driver manufactured by Maxim which in turn is connected to a DB9 MALE plug. The DB9 MALE plug is connected to an FTS radio. The MAX RS-232 driver converts the binary communication of the PIC microprocessor to the RS-232 protocol of the FTS radio when the PIC microprocessor is sending serial data to the FTS radio. When serial data is received from the FTS radio, the MAX microprocessor converts the RS-232 communication of the FTS radio to the binary communication of the PIC microprocessor.

The PIC processor is also connected to relays which operate devices connected to the relays such as door locks.

The solar panel unit is a high output micro-thin solar panel unit connected to a low drop-out voltage regulator manufactured by National Semiconductor which is used to charge a 12 V 7AHr storage battery. A solar voltage ("Vsolar") monitor, a voltage output ("Vo") monitor, a battery voltage ("Vbatt") monitor are used to determine optimum conditions for battery charging. A 3V switch-mode regulator is used to power the low-power PIC processor. Power generated by the solar panel unit is used to charge the storage battery. The low drop-out regulator regulates the amount of charge given to the storage battery up to a defined maximum voltage such that the storage battery is not overcharged. The low voltage regulator maintains a constant voltage output when sufficient sun-light is falling on the solar panel.

In operation, the PIC microprocessor has a stand-by low power mode and a full power active mode. The PIC microprocessor in the stand-by mode operates on a low power consumption of 5 to 6 milliamps of current which is normally supplied by the solar panel unit. If the solar panel unit is not operational, such as because it is covered with snow, power to the PIC microprocessor is supplied by the storage battery. The 12V 7AHr rechargeable lead-acid battery used in the system has a stand-by life of about 10 to 11 days before it requires a recharge from the solar panel unit.

The PIC microprocessor operates on a normally closed input in stand-by mode as it waits for an open loop signal (alternatively, a normally open loop input can be used). When a zone is triggered, (for example if a door is opened on zone 1), the input loop for that zone opens and the voltage on that zone goes to about 5V and the PIC microprocessor goes into an active mode and turns on an electronic switch (a field effects transistor manufactured by International Rectifier) which in turn switches on the FTS radio. The triggered zone is an analogue input which is used by the PIC microprocessor to generate an electronic alarm message corresponding to that zone input. The alarm message is stored in the scratch pad memory of the PIC microprocessor.

The FTS radio then auto-enrolls itself into a cellular network which takes about 30 seconds. After the enrollment is complete, the FTS radio sends a request to the PIC microprocessor that it is now safe to send the zone input alarm message which has been stored in the PIC microprocessor. The PIC microprocessor waits for the enrollment before sending the alarm signal to the FTS radio for transmission to a central monitoring station or other monitoring device. The message is received by the FTS radio and the FTS radio sends the message through the control channel portion of the cellular network. The PIC microprocessor then switches off the FTS radio to conserve power and starts a timer for a pre-set period of time so that subsequent triggered events will not be transmitted until the set time expires. After the time expires, the new event will restart the cycle described above.

The relays and the FTS radio require 12V DC for operation, the driver integrated circuits require 5VDC for operation and the PIC microprocessor requires 3 VDC for operation. The FTS radio operates at 100 milli-amps when it is energized.

Fiberglass Parcel/Postage Box

Figure 7:
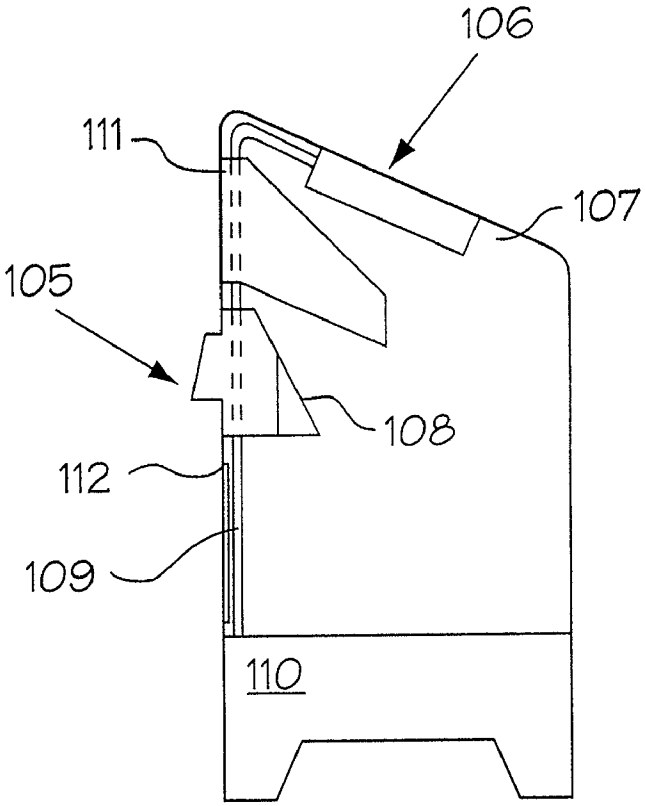
FIG. 7 is a side view of a fiberglass parcel/postage box according to the invention.
Figure 6:
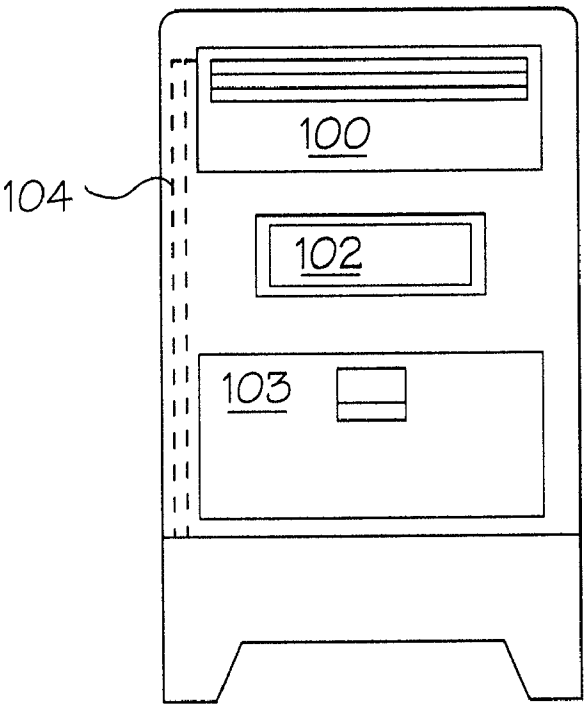
FIG. 6 is a front view of a fiberglass parcel/postage box according to the invention.

Referring to FIGS. 5, 6 and 7, in another embodiment of the invention, the monitoring unit can be integrated into a postal box during manufacture. The postal box of FIGS. 5, 6, and 7 is constructed from fiberglass and includes a weighted base 110 to ground the box. The main compartment of the box includes two doors. The upper door 100 is for receiving mail and parcels. The lower door 103 is a pick-up door by which a mail/courier employee gains access to the contents of the box during a pick-up.

The box includes a solar panel 105 which is affixed to the front of the box for locations where the box is located up against a building or a wall. The solar panel 105 is inclined slightly upwards toward the sky to capture the sun's rays. Alternatively, a solar panel 106 can be affixed to the inclined top of the box for open area locations. The monitoring unit is housed in a sealed compartment 108 or 107 next to the solar panel 105 or 106 as the case may be and connected to it. A hollow tube 104 attached to the inside of the box houses cables connecting the various contacts and sensors of the box to the monitoring unit 108 or 107 in a similar manner to the postal box shown in FIG. 1.

For very remote or low sunlight locations, an additional battery (not shown) can be included in the base 110 and connected to the monitoring unit 108 or 107 using wiring which is carried inside a second hollow tube 109. The box is equipped with remote lock-down devices which lock the doors 100 and 103 to prevent entry into the box in response to a lock-down signal. The doors 100 and 103 can be unlocked by the appropriate signal transmitted from a central monitoring station or a handheld device.

Figure 9:
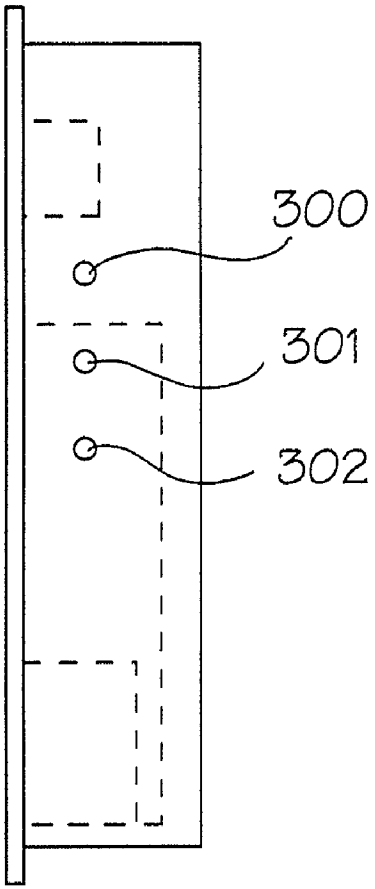
FIGS. 8 and 9 are block diagrams of a portable monitoring unit according to the invention.
Figure 8:
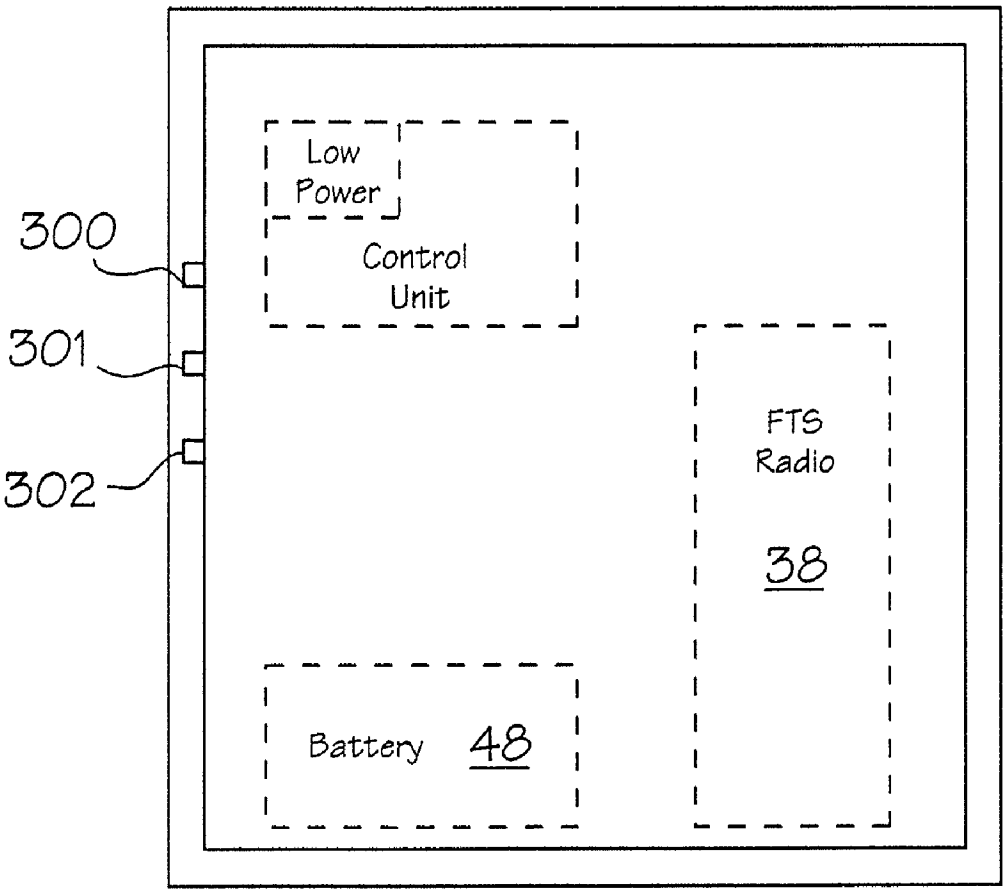
Figure 10:
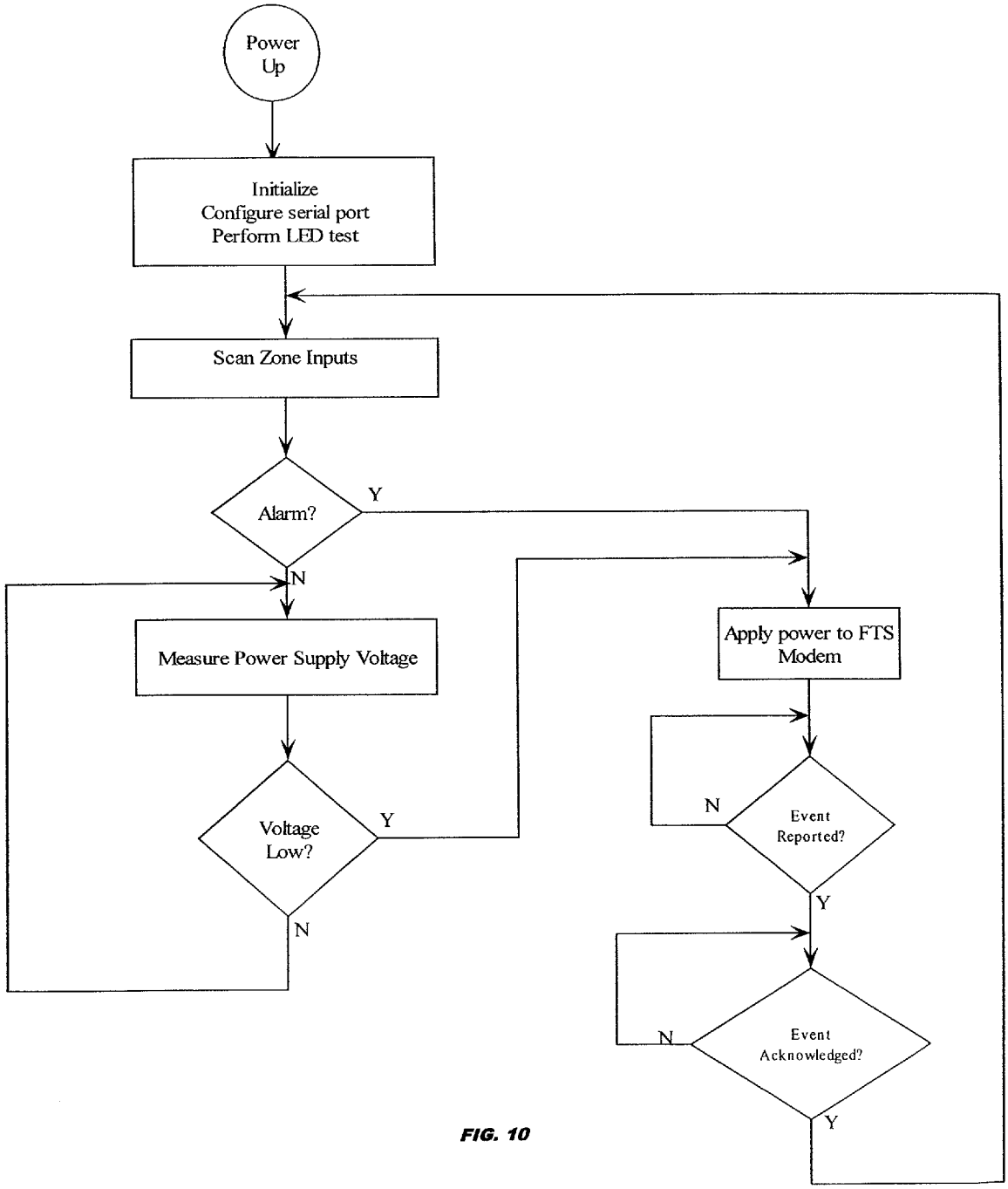
FIG. 10 is a flow chart which illustrates the major operations of the control program.

Referring to FIGS. 8 and 9, in a further embodiment of the invention, a monitoring unit is housed in a portable housing which includes a low power control unit, a battery and a radio as the major components, connected to each other and other components (not shown) in a similar manner to the previous embodiments discussed above. The portable housing can be a suitcase. The portable unit includes a connector 300 for connecting the unit to a solar panel, connector 301 for connecting the unit to sensors and/or controlled devices and connector 302 for connecting the unit to an antenna.

The monitoring unit may include the sensor, or may exclude the sensor but be connectable to it.

The monitoring unit can also be used in applications other than containers, such as in trucks, boats, grain silos, etc. It will be understood by those skilled in the art that the monitoring unit can be used with any unit, equipment, enclosure or object that can be equipped with such a monitoring unit. For example, in trucks, the portable monitoring unit can be connected to a fixed low temperature sensor such as model SNIF-20 manufactured by WINLAND or a high low temperature sensor such as model WINUTAL manufactured WINLAND, to monitor temperature in refrigeration trucks whereby if the temperature in the truck rises above or below a certain level due to a failure of the climate control system, a trouble signal is sent by the monitoring unit to a central monitoring center to locate the driver. The monitoring unit can also be used to monitor opening of doors in trucks, trains, shipping containers and the like and to send an intrusion signal upon unauthorized entry. Alternatively, the monitoring unit can be wired to a weight sensor on a floor mat such that it can send an intrusion signal when an intruder steps on the mat.

The object to be monitored can also be a boat, and the monitoring unit can act as a flood detector by setting off an alarm once water is detected inside the boat.

It will be understood by those skilled in the art that depending on the object being monitored and the sensors being used, the wiring arrangement described in the previous embodiments will have to be modified accordingly.

Figure 11:
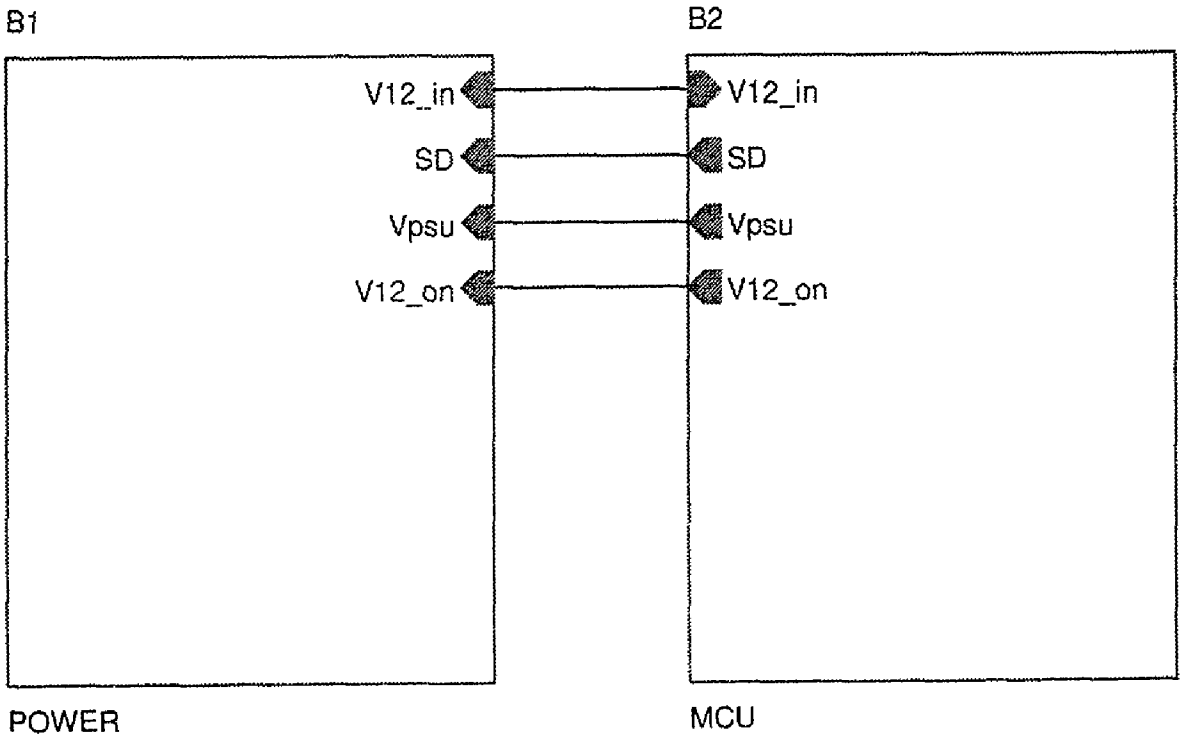
FIG. 11 is a circuit diagram of another embodiment of a monitoring system of this invention.
Figure 12:
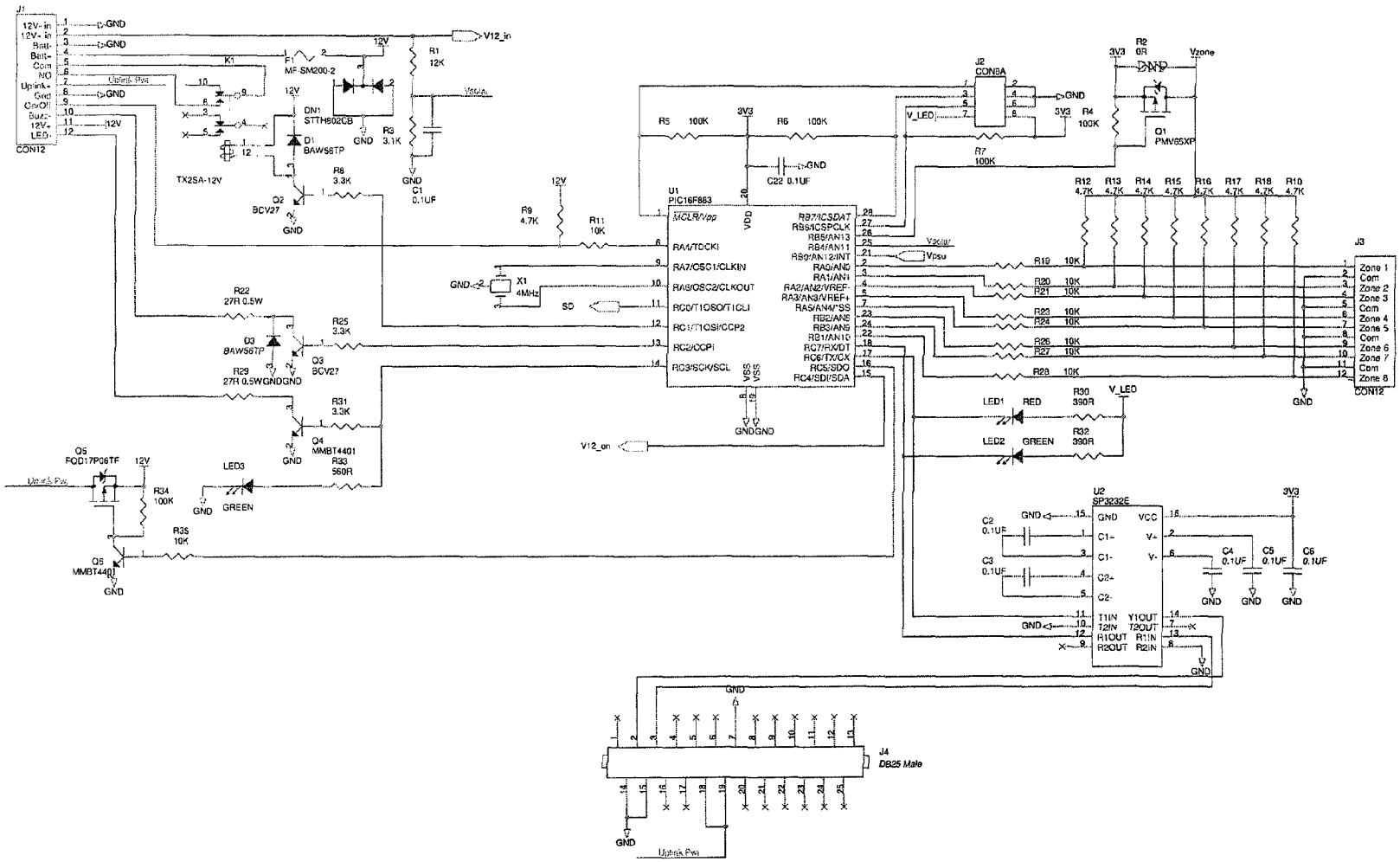
FIG. 12 is a circuit diagram of another embodiment of a monitoring system of this invention.
Figure 13:
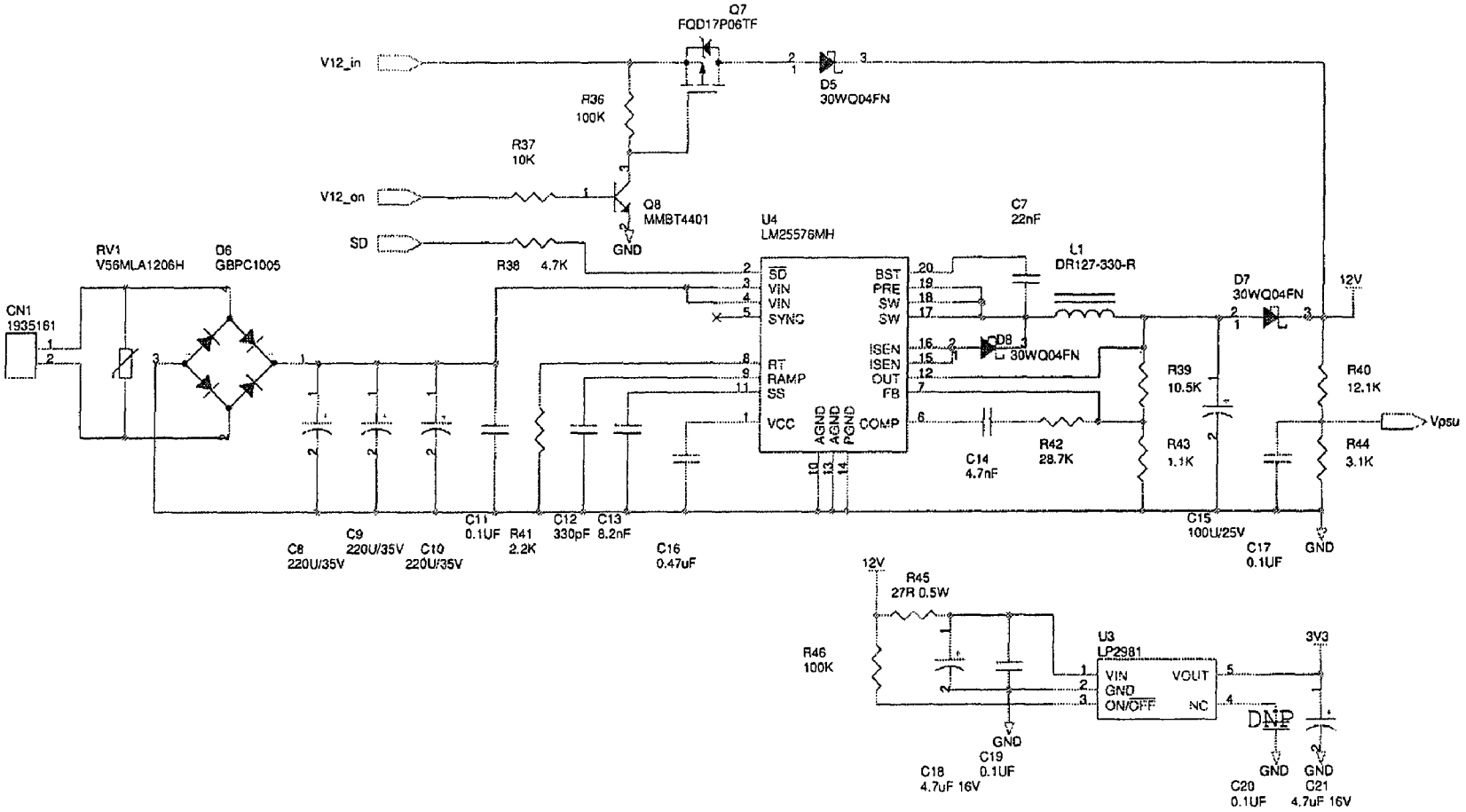
FIG. 13 is a circuit diagram of another embodiment of a monitoring system of this invention.

FIGS. 11, 12, and 13 are circuit diagrams showing another embodiment of a monitoring system embodying the principles of the invention. In this embodiment, the monitoring system still puts the radio to sleep to save power as in the other above-noted embodiments but it has more uses and different programming to make it work better for these uses. It can be used as an alarm or notification system for camps, cottages, boats, a temporary alarm, classrooms, airplane, walkways, new home construction, power substations, sewer contacts, and generally, any place where there is no power or limited power and no phone lines. The circuit board is a 25-pin connector so it will plug directly into the numerex radio. The board also puts the radio asleep or does not power up the radio until needed. The board has 8 zones that can be configured in any configuration, and can be N/O (normally open), N/C (normally closed) or 24-hr zone. Zone 1 is a 45 second delay zone, if needed, by setting jumper 1 to 'on'. When setting jumper 2 to 'on', this system has a relay that trips for 60 seconds when a zone is tripped. This embodiment arms and disarms (i.e. on and off) with a ground to on/off if jumper 3 is 'off' or a ground pulse to zone 8 if jumper 3 is 'on'. The embodiment of this system can also have an LED-input with a built-in resistor for an external status light, if required. There is a buzzer output that sounds once for unit 'on' (i.e. armed) and twice for 'off' (i.e. disarmed). The system has a 16V AC input to allow the unit to run on AC power, as well as a 12V− and a 12V+ input for solar power input. This system has its own regulator so that it will not overcharge the batteries.

The circuit board also has a 25-pin connector so that it can plug directly into the Uplink radio 25-pin and control the radio. A daily test signal with the current voltage of the unit can be sent to the central station, and resent to the customer. Information such as openings (i.e. 'on' or 'armed signal') and closings (i.e. 'off' or 'disarmed signal') can be sent to the central station, as well as alarms and restorals, and low battery signals.

The system can also be programmed to latch the relay and not turn off the radio when a zone trips so that data can be sent to the radio and/or a tracking device or any device hooked to the relay can be turned on.

The system has an onboard status LED and a swinger shutdown built-in where the unit only sends three alarms per zone, and then shuts down that zone for 1 hour.

The system also has a buffer. It will try to send data to the central station for a maximum of 4 minutes before shutting down for 30 minutes. This is repeated 5 times. It will then buffer the alarm and send it with the next transmission.

We claim:

1. A monitoring system for monitoring an object, the system comprising:

a microprocessor including, a memory to store data, a control program executed by said microprocessor;

said microprocessor having a stand-by mode and an active mode;

a communications means connected to said microprocessor for transmitting data from said microprocessor to a monitoring station wherein said communications means has a sleep mode and an active mode;

a zone monitoring device in communication with said microprocessor, said microprocessor normally in said stand-by mode, a power source for supplying power to said microprocessor, communications means and zone monitoring device;

wherein upon said microprocessor receiving an input signal from said zone monitoring device, said control program directs said microprocessor to, switch to active mode, generate and store in said memory an alarm message corresponding to said input signal from said zone monitoring device, activate said communications means, and transmit said alarm message to a monitoring station.

2. The monitoring system according to claim 1, further including a controlled device connected to said microprocessor and controlled by said control program.

3. The monitoring system according to claim 2, wherein said controlled device is a motor driven lock.

4. The monitoring system according to claim 1, wherein said zone monitoring device is selected from the group consisting of magnetic contacts, smoke detectors, carbon monoxide detectors, sniffer sensors, temperature sensors, motion sensors, potentiometer switches, mercury switches, fluid sensors, and weight sensors.

5. The monitoring system according to claim 1, wherein said communications device is a wireless device.

6. The monitoring system according to claim 1, wherein said power supply is a battery.

7. The monitoring system according to claim 6, further including a solar panel connected to said battery.

8. The monitoring system according to claim 1, further including a GPS device connected to said processor.

9. The monitoring system according to claim 1 wherein: the object is selected from the group consisting of a cottage, a boat, a camp, a classroom; an airplane, a home, a power substation and a sewer contact.

10. A device for monitoring an object, the device comprising:

a microprocessor including, a memory to store data, a control program executed by said microprocessor;

said microprocessor having a stand-by mode and an active mode, wherein said microprocessor is normally in said stand-by mode;

a communications means connected to said microprocessor for transmitting data from said microprocessor to a monitoring station;

a power source for supplying power to said microprocessor and communications means;

wherein upon said microprocessor receiving an input signal, said control program directs said microprocessor to, switch to active mode, generate and store in said memory an alarm message corresponding to said input signal, activate said communications means, and transmit said alarm message to a monitoring station.

11. The device according to claim 10, wherein the microprocessor is communicable with a zone monitoring device.

12. The device according to claim 10, further including a zone monitoring device in communication with the microprocessor.

13. The device according to claim 11 or 12, wherein said zone monitoring device is selected from the group consisting of magnetic contacts, smoke detectors, carbon monoxide detectors, sniffer sensors, temperature sensors, motion sensors, potentiometer switches, mercury switches, fluid sensors, and weight sensors.

14. The device according to claim 11 or 12, wherein the zone monitoring device activates a controlled device connected to said microprocessor and controlled by said control program.

15. The device according to claim 14, wherein said controlled device is a motor driven lock.

16. The device according to claim 10, wherein said communications device is a wireless device.

17. The device according to claim 10, wherein said power supply is a battery.

18. The device according to claim 17, further including a solar panel connected to said battery.

19. The device according to claim 10, further including a GPS device connected to said processor.

20. The device for monitoring an object according to claim 10 wherein the object is selected from the group consisting of a cottage, a boat, a camp, a classroom; an airplane, a home, a power substation and a sewer contact.

* * * * *